US005393100A

United States Patent [19]

Coe

[11] Patent Number: 5,393,100

[45] Date of Patent: Feb. 28, 1995

[54] MEDICINE SCHEDULER

[75] Inventor: Matthew Coe, Cedar Grove, N.J.

[73] Assignee: PharmaDesign, Inc., Warren, N.J.

[21] Appl. No.: 174,784

[22] Filed: Dec. 23, 1993

[51] Int. Cl.[6] ..... B42D 15/00

[52] U.S. Cl. ..... 283/115; 283/66.1; 283/117; 283/900

[58] Field of Search ..... 283/66.1, 115, 117, 283/900; 281/2, 45, 51

[56] References Cited

U.S. PATENT DOCUMENTS 5,031,937 7/1991 Nellhaus ..... 283/52.1
5,102,169 4/1992 Mayfield ..... 283/115
5,261,702 11/1993 Mayfield ..... 283/115

*Primary Examiner*—Willmon Fridie
*Attorney, Agent, or Firm*—Bryan, Levitin & Bab

[57] ABSTRACT

A support carries a pad of medicine schedules and a pad of medicine display cards. Each medicine schedule has a place for a medication sticker with a picture of the tablet or other medication involved, and space for instructions concerning that medication. Each display card carries multiple stickers of a single medication. An individual sticker can be lifted from the card and placed on the medicine schedule. A physician writes instructions concerning the medicine. The patient is provided with the medicine schedule and thus has a graphic indication of which medicine must be taken and the instructions concerning that medicine.

13 Claims, 2 Drawing Sheets

MEDICINE SCHEDULER

FIELD AND BACKGROUND OF THE INVENTION

The present invention relates, in general, to methods and apparatuses for scheduling when a patient must take his or her medication, and in particular to a new and useful medicine scheduler which is particularly useful for elderly patients who may become confused when they must take several different medications according to different dosages, times of day and the like.

It is conventional for a doctor to prescribe one or more medications for a patient to take one or more times during the day, and perhaps at certain times of the day. The medications are usually in the form of pills but may also be powders and liquids.

Particularly for the elderly, often more than one medication must be taken on a daily basis. Various devices have been provided to make it easier for patients, in particular, elderly patients, to organize their daily medication. One of these devices is in the form of a container having seven different compartments, each for a different day of the week. Room is provided in each compartment for one or more pills which the patient must take on that day.

Such a device does not provide any indication on when the tablets contained in a particular compartment must be taken. If multiple tablets must be taken at different times during the day, the presence of several of the same tablet in the compartment does not give the elderly patient any information other than that all of those tablets must be taken during a particular day.

SUMMARY OF THE INVENTION

An object of the present invention is to provide a medicine scheduler which can be filled out by a doctor and provided to a patient with a graphic indication of the appearance of each tablet or medicine which must be taken, and specific instructions concerning each medication.

For the purpose of this disclosure, the term "medication" is used to include medicines in tablet, powder, liquid, ointment or any other form representing discrete dosages to be taken at least once, and generally, at periodic intervals during the day or during a number of days.

The apparatus of the invention comprises a packet containing a pad with a multiplicity of medicine schedules, each to be filled out by the physician and supplied to a patient, a plurality of medication display cards, each carrying a multiplicity of stickers with each sticker representing a single dosage of the medication, for example, a single tablet, and information concerning the tablet. A large number of cards, each representing a different medication are spiral bound or otherwise attached in a convenient manner to the packet. This allows the physician to thumb through the medications until the medication required for a particular patient is reached. At that point, a physician removes one of the stickers and places it at a particular location on the medicine schedule. Space is provided next to the location for instructions, for example, instructions to the patient concerning the number of tablets or the number of times a day, or both, during which the medication should be taken by the patient.

With elderly patients, generally a single medicine schedule carries stickers representing several different tablets or medications, each with particular instructions concerning that medication. In this way, the patient, in particularly an elderly patient who is susceptible to confusion, has a visual reference to compare the actual tablet to a picture of the actual tablet on the medicine schedule, with clear instructions on when that medicine must be taken.

The packet advantageously has three panels which are folded in an overlapping manner into a small book shape. One of the panels carries the pad of medicine schedules, preferably the right-hand panel, which is in the best position for right-handed physicians. The central panel contains a bound collection of medication display cards, each with a multiplicity of stickers.

The left-hand panel which also serves as the cover for the book, has a closure flap and also a complete listing of all medications included in the cards. Color coding can also be provided to help the physician more quickly flip to the desired medication for retrieving a sticker for a patient's medicine schedule.

A further object of the present invention is to provide a method of scheduling medication which provides graphic and written instructions to a patient, particularly an elderly patient who must take multiple medications over the course of time.

A still further object of the present invention is to provide a medicine scheduler which is simple in design, rugged in construction and economical to manufacture, and which can advantageously be supplied to a physician free of charge. The cost for the packet can be paid by the pharmaceutical companies in exchange for their medicines being included in the medication display cards.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which an embodiment of the invention is illustrated.

DESCRIPTION OF THE PREFERRED EMBODIMENTS

Figure 1:
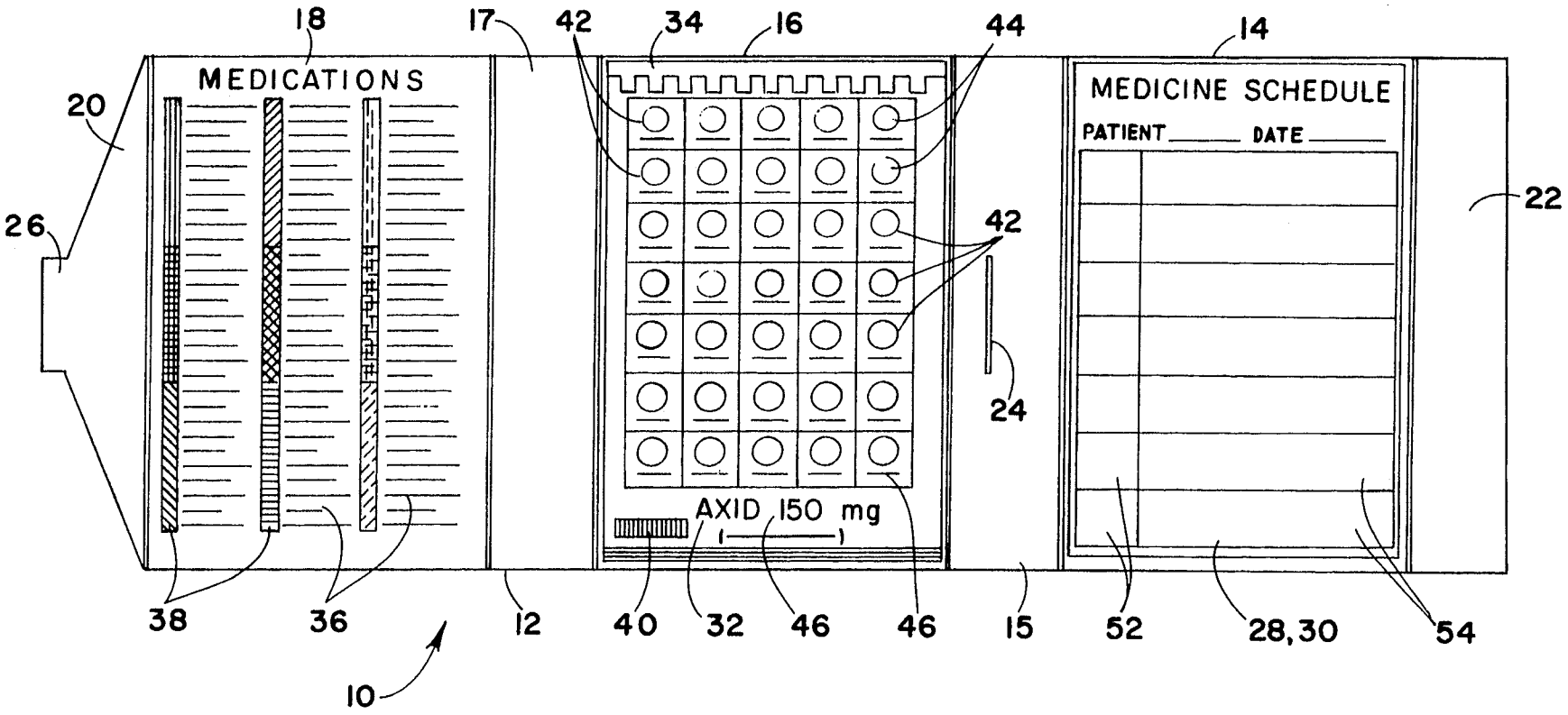
FIG. 1 is a top plan view of the medicine scheduler packet of the present invention in an open position.
Figure 4:
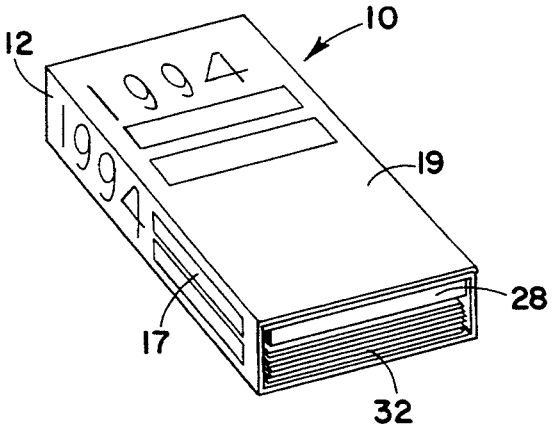
FIG. 4 is a perspective view of the packet in its closed position.

Referring to the drawings in particular, the invention embodied therein comprises a medicine scheduler in the form of a foldable packet generally designated 10 shown in its open position in FIG. 1 and its closed position in FIG. 4. Packet 10 comprises a three panel support 12 made of cardboard or other flat stiff material.

Support 12, comprises a first panel 14 connected to a central second panel 16 which in turn is connected to third panel 18. Panels 14 and 16 are connected to each other by a pair of fold lines and a spacer panel 15. In likewise fashion, panels 16 and 18 are connected by a pair of fold lines and a spacer panel 17. The width of spacer panels 15 and 17 equal the thickness of a pad 28 containing a multiplicity of medicine schedules 30, and a pad 32 containing a multiplicity of medication display cards stacked one on top of the other, and bound together at a pivoting binding 34, such as a ring-binding or spiral-binding.

Third panel 18 carries a printed listing 36 of all medications represented in the pad of cards 32. Three separate and different colors are provided in each of three color coded bands 38 next to the three portions of list 36. These correspond to colors at a color code area 40 on each card. This facilitates the location of a card corresponding to a medication selected from list 36, so that the physician can locate the card more quickly. To further help the physician, list 36 is in alphabetical order, as are the cards in pad 32.

Figure 2:
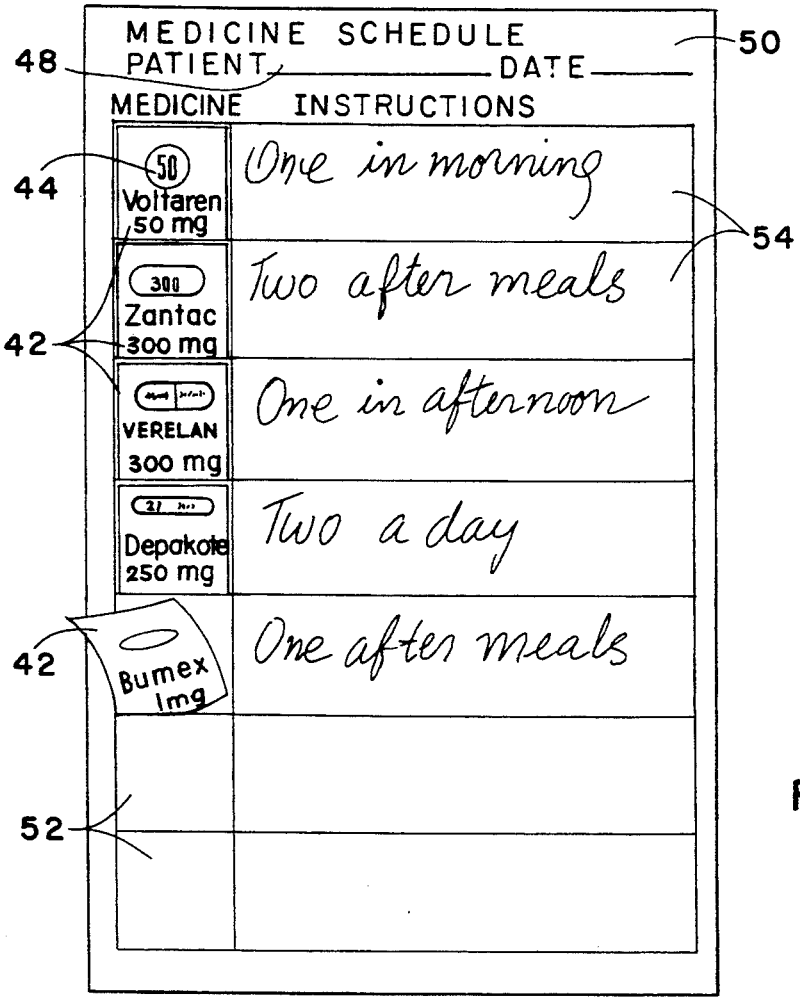
FIG. 2 is a plan view of a medicine schedule of the present invention, on an enlarged scale.

A multiplicity of stickers 42 are carried on each card, each sticker containing a graphic picture of the medicine, for example, a tablet 44 shown in FIG. 2, and medication information 46 under the tablet, such as the name of the medication and dosage information contained in each tablet. In the example shown, 35 stickers are on each card. The same medication information 46 is reproduced at the bottom of each card of the card stack 32 for reference by the physician, and in the case where all stickers have been used up, indicating the need for a new card or a new packet.

Advantageously, the first panel 14 carrying the pad of medicine schedules 28 is on the right hand side of the support 12, for right-handed physicians. Left-handed packets may also be manufactured and provided where list 36 is on the right pad 28 is on the left, for left-handed physicians. Packets 10 thus can come in right-handed and left-handed varieties.

The preferred location for the pad of display cards 32 is in the center panel but the positions of all three functional units, that is, medicine schedule pad 28, medication display card pad 32 and medication list 36, can be interchanged in any desired manner.

Advantageously, the packet can be closed into a book shape shown in FIG. 4 and held in the closed position by a slot 24 in panel 15 and a cover flap 20 have a tab 26 which can be inserted into slot 24. End flap 22 may also be provided. The book-shaped packet 10 shown in FIG. 4 can be supplied to physicians free of charge. The packets would be paid for by pharmaceutical companies in exchange for a listing of their medication on list 36 and inclusion of a corresponding display card in pad 32.

Referring to FIG. 2, in use a physician will tear one medicine schedule 30 from pad 28. The physician will then include the patient's name at space 48 and the date at space 50. The physician will then select desired medications from list 36, and using color code 38, quickly locate the appropriate card in pad 32 using color code area 40. One of the stickers 42 will be removed from the card and placed at a sticker location 52. In the medicine schedule 30 shown, seven sticker locations are provided, one above the other in a column. Next to each sticker location, a rectangular instruction area 54 is provided where the physician can handwrite or typewrite instructions, for example, "one in morning" "two after each meal" etc. The reader is cautioned that the examples given in FIG. 2 are for illustration only, and are not actual or correct instructions for the medications illustrated.

In use, the patient quickly sees the picture 44 of each tablet or medication and can easily read the instructions in area 54 thus avoiding errors. Even if multiple medicines must be taken (five different tablets are shown in FIG. 2), each with its own different instructions, confusion will still be avoided. Again, the instructions illustrated are fictitious.

Figure 3:
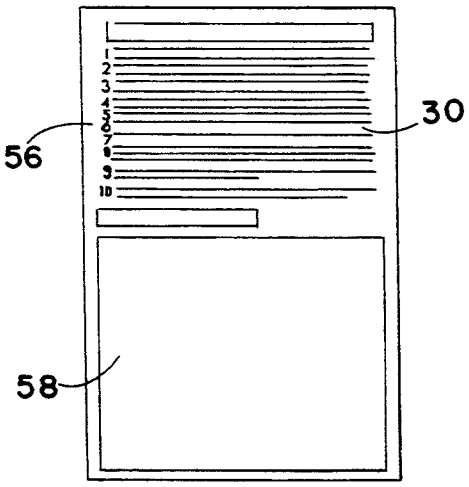
FIG. 3 is a rear plan view of the medicine schedule.

As an added feature, the back of the medicine schedule 30 shown in FIG. 3 can include a list of general information 56, for example, a list entitled "The Ten Do's and Dont's of Prescription Medicine". Advantageously, these "do's and dont's" are as follows:

1. Do take medicines exactly as prescribed and finish the drug treatment even if symptoms subside.
2. Don't leave your physician's office without a clear understanding of how and when to take your medication.
3. Do tell your doctor exactly what medicines have been prescribed for you by other physicians.
4. Don't take medicine prescribed for a friend or relative or offer your medicine to others, even if the symptoms are the same.
5. Don't double the amount of medication you take if you miss a dose.
6. Do store your medicines in their original containers and as instructed on the label.
7. Don't consume alcoholic beverages with medicines until you check with your doctor.
8. Do check the expiration date on the medicine label to make sure that the medicine is still effective.
9. Don't hoard your drugs at home. Dispose of them when you have stopped taking the medicine prescribed for you.
10. Do consult with your physician if there are bothersome symptoms or side effects from your medicine.

This list of ten do's and dont's has been adapted from *Ten Guides To Proper Medicine Use*, The Council On Family Health.

Returning to FIG. 3, a large area 58 is provided below the list where special instructions can be inserted by the physician, for example, instructions concerning exercise, meals, the drinking of liquids, etc.

While a specific embodiment of the invention has been shown and described in detail to illustrate the application of the principles of the invention, it will be understood that the invention may be embodied otherwise without departing from such principles.

What is claimed is:

1. A medicine scheduler comprising, in combination:

a plurality of medication display cards, each carrying a multiplicity of separate removable stickers, each sticker having an easily identifiable picture of a medication thereon;

at least one medicine schedule containing a plurality of sticker sites for receiving a separate sticker at each site, and a separate instruction space closely associated with each sticker site for receiving written instructions concerning taking of the medication pictured on a sticker at a respective sticker site; and a support, said plurality of medicine display cards being movably mounted to the support, and a multiplicity of medicine schedules in a pad attached to the support.

2. A medicine scheduler according to claim 1, wherein the support includes a listing of all medication represented in medication display cards movably mounted to the support.

3. A medicine scheduler according to claim 2, wherein the support includes at least three panels connected by fold lines to each other, the pad of medicine schedules being attached to a first one of the panels, the plurality of medicine display cards being movably mounted to a second one of the panels and the list of medications being on a third one of the panels.

4. A medicine scheduler according to claim 3, wherein the first, second and third panels include a middle panel and opposite end panels connected to the middle panel, the support including a spacer panel connected between the middle panel and each of the end panels.

5. A medicine scheduler according to claim 4, wherein the medicine display cards are movably mounted to the middle panel, the pad of medicine schedules being attached one of the end panels.

6. A medicine scheduler according to claim 3, wherein each sticker includes a printed name of the medication pictured on the sticker, and dosage information concerning the medication.

7. A medicine scheduler according to claim 3, including a color code associated with groups of medications in the list, and a corresponding color code area on each of the medication display cards of a respective group.

8. A method of scheduling medication for a patient, comprising:

providing a plurality of medication display cards, each carrying a multiplicity of separate removable stickers, each sticker having an easily identifiable picture of the medication thereon;

providing at least one medicine schedule containing a plurality of sticker sites for receiving a separate sticker at each site, and a separate instruction space closely associated with each sticker site for receiving written instructions concerning taking of the medication pictured on a sticker at a respective sticker site;

selecting a sticker corresponding to a medication to be taken by a patient, from one of the medication display cards, and placing it on one of the sticker sites;

writing instructions concerning the patient's taking of the medication in the instruction space adjacent the sticker site carrying the sticker; and providing the plurality of medication display cards in a movable mount on a central panel of a multi-panel support, providing a multiplicity of medicine schedules in a pad on another one of the panels of the support, and including a list of all medication represented in the medication display cards, on another panel of the support.

9. A method according to claim 8, including selecting a plurality of stickers representing different medications, placing each of the stickers at separate sticker sites, and writing instructions in each respective instruction space concerning each respective medication represented at a respective sticker site.

10. A method according to claim 8, wherein the pad of medicine schedules is provided on a right-hand panel compared to a location of the display cards.

11. A method according to claim 8, wherein the pad of medicine schedules is provided on a left-hand panel compared to a location of the display cards.

12. A method according to claim 8, including providing a color code associated with each of a plurality of groups of medications listed on the medication list, and providing a corresponding color code area on each medication display card, corresponding to the color code in the list for the medication of that card.

13. A method according to claim 8, including providing the plurality of medication display cards and the at least one medicine schedule, to a physician free of charge, the physician performing the steps of selecting a sticker and writing the instructions.

* * * * *